US006267034B1

(12) United States Patent
Beckwith

(10) Patent No.: US 6,267,034 B1
(45) **Date of Patent: *Jul. 31, 2001**

(54) APPARATUS FOR CUTTING AND STACKING A MULTI-FORM WEB

(75) Inventor: Glenn Beckwith, Cambridge (CA)

(73) Assignee: RDP Marathon Inc., Quebec (CA)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/993,407

(22) Filed: Dec. 18, 1997

Related U.S. Application Data

(63) Continuation of application No. 08/736,785, filed on Oct. 25, 1996, now abandoned, which is a continuation of application No. 08/207,235, filed on Mar. 7, 1994, now abandoned, which is a continuation of application No. 07/938,617, filed on Sep. 1, 1992, now abandoned.

(51) Int. Cl.[7] ..... B26D 1/62; B31B 1/16

(52) U.S. Cl. ..... 83/305; 83/302; 83/344; 83/346; 83/561; 101/226; 101/248; 400/621; 493/370

(58) Field of Search ..... 83/283, 304, 305, 83/344, 346, 299, 301, 302, 303, 347, 528, 561, 563, 343; 493/370; 101/248, 226; 400/621

(56) References Cited

U.S. PATENT DOCUMENTS

| | | | |
|---|---|---|---|
| 1,185,761 | | 6/1916 | Bewsic ..... 83/344 |
| 1,876,838 | * | 9/1932 | Biggert, Jr. ..... 83/305 X |

(List continued on next page.)

FOREIGN PATENT DOCUMENTS

| | | | |
|---|---|---|---|
| 652734 | 11/1962 | (CA) . | |
| 671724 | 10/1963 | (CA) . | |
| 1942355 | 3/1971 | (DE) . | |
| 2315813 | 10/1973 | (DE) . | |
| 2323319 | 11/1974 | (DE) . | |
| 2718793 | 11/1977 | (DE) . | |
| 2014813 | 5/1978 | (DE) . | |
| 2905716 | 8/1980 | (DE) . | |
| 706553 | 6/1931 | (FR) . | |
| 2278458 | 2/1976 | (FR) | 83/346 |
| 61-27829 | 2/1986 | (JP) . | |
| 556000 | 6/1977 | (RU) . | |
| 587060 | 1/1978 | (RU) . | |

OTHER PUBLICATIONS

Research Disclosure, Mar. 1974, p. 24.

*Primary Examiner*—Clark F. Dexter
(74) *Attorney, Agent, or Firm*—Venable; Michael A. Gollin

(57) ABSTRACT

A high speed rotary cutter assembly for transversely cutting a moving web, comprising a cutting roll and an anvil roll rotating at web speed which are selectively movable toward and away from one another to set the rotary cutter assembly in operative and idle modes, respectively. The invention also extends to a web handling device for forming a continuous multi-form web into a stack, comprising a folder assembly laying successive forms of the web in a superposed relationship on a table to form a stack. A temporary stack support assembly is extended along an arcuate descending path between the folder assembly and the table when the stack is completed for temporarily holding the incoming folded product until the completed stack on the table has been ejected.

8 Claims, 17 Drawing Sheets

U.S. PATENT DOCUMENTS

| | | | | |
|---|---|---|---|---|
| 1,984,913 | | 12/1934 | Biggert, Jr. | 83/305 X |
| 2,429,944 | | 10/1947 | Rayburn et al. | 83/346 X |
| 2,642,938 | * | 6/1953 | Hallden | 83/305 |
| 2,749,984 | * | 6/1956 | Hallden | 83/305 |
| 2,896,946 | | 7/1959 | Barratt et al. | 271/6 |
| 3,136,194 | * | 6/1964 | Greenhalgh | 83/305 |
| 3,405,580 | | 10/1968 | Hallden | 83/305 |
| 3,570,348 | | 3/1971 | Hallden | 83/305 X |
| 3,606,811 | * | 9/1971 | Hallden | 83/305 |
| 3,745,864 | | 7/1973 | Watson | 83/295 |
| 4,055,258 | | 10/1977 | Schneider | 214/85 C |
| 4,058,041 | | 11/1977 | Ito | 83/305 |
| 4,188,843 | | 2/1980 | Dickey | 83/344 X |
| 4,205,596 | | 6/1980 | Chesnut | 83/344 X |
| 4,218,943 | | 8/1980 | Osburg | 83/304 |
| 4,620,827 | | 11/1986 | Sameshima et al. | 414/114 |
| 4,640,164 | | 2/1987 | Pavlov | 83/304 |
| 4,742,741 | | 5/1988 | Hallberg et al. | 83/305 X |
| 4,770,078 | | 9/1988 | Gautier | 83/344 |
| 4,919,589 | | 4/1990 | Krappitz et al. | 414/798.9 |
| 4,928,811 | | 5/1990 | Waineo | 198/774 |
| 5,024,128 | | 6/1991 | Campbell, Jr. | 83/26 |
| 5,058,472 | | 10/1991 | Kakko-Chiloff | 83/344 |
| 5,098,366 | | 3/1992 | Gressman | 83/305 X |
| 5,174,185 | | 12/1992 | Aichele | 83/346 |
| 5,348,527 | * | 9/1994 | Beckwith | 493/413 |

* cited by examiner

APPARATUS FOR CUTTING AND STACKING A MULTI-FORM WEB

This application claims the benefit of U.S. Ser. No. 08/736,785, filed Oct. 25, 1996, now abandoned as a continuing application, which is a continuation of U.S. Ser. No. 08/207,235, filed Mar. 7, 1994, now abandoned, which is a continuation of U.S. Ser. No. 07/938,617, filed Sep. 1, 1992, now abandoned, the specifications of which are hereby incorporated by reference.

FIELD OF THE INVENTION

The invention relates to equipment for handling web-like materials, such as paper for example, and more particularly to a high speed rotary cutter assembly capable of selectively assuming operative or idle modes. The invention also extends to a high speed device for handling a multi-form web, capable of folding the web forms into separate and independent stacks without any interruption of the web folding operation.

BACKGROUND OF THE INVENTION

Devices to automatically fold a continuous multi-form web into a stack are well-known and wide spread in the printing industry. Typically, such devices employ a folder assembly in the form of a swing chute to lay the incoming forms of the web in a superposed relationship to form a stack. In most applications, the forms on the web are separated from one another by transverse perforation lines at which the folds are made in order to form the stack.

The major drawback of existing folding machines is that they can operate only at limited speeds. Therefore, a single folding machine is not capable of processing the output of a high speed printing press. As a result, the cost effectiveness of these devices is limited since a normal production line must incorporate several folders running in parallel.

OBJECTS AND SUMMARY OF THE INVENTION

An object of the present invention is a high speed rotary cutter for a web-like material which can selectively assume an operative or idle mode, thereby being capable to perform a variety of cutting operations simply by changing the actuation sequence of the cutter.

Another object of the invention is a web handling device capable of folding a multi-form web into stacks, which can operate continuously, without the necessity of interrupting the folding operation in order to allow the removal of a completed stack from the machine.

As embodied and broadly described herein the invention provides a rotary cutter assembly for transversely cutting a moving web-like material, the rotary cutter assembly comprising:

a blade carrier roll;

an elongated blade mounted to the blade carrier roll, the blade extending along an axis of rotation of the blade carrier roll;

an anvil roll (for the purpose of this specification "anvil roll" shall mean a roll which is free of a cutting edge which cooperates with the blade carrier roll in order to cut the web) mounted generally parallel to the blade carrier roll and defining therewith a nip through which the web-like material is advanced, the anvil roll being capable of moving relative to the blade carrier roll between operative and idle positions, in the operative position the anvil roll being proximate to the blade carrier roll to effect a cut in the web-like material by the action of the elongated blade pressing the web-like material against the anvil roll, in the idle position the anvil roll being spaced apart relative to the blade carrier roll, thereby creating a space to allow the web-like material to yield away from the blade carrier roll upon engagement by the elongated blade in order to preclude cutting of the web-like material;

an actuator coupled to the anvil roll for selectively moving the anvil roll between its operative and idle positions; and a drive for rotating the blade carrier and anvil rolls at respective tangential speeds correlated to a translational speed of the web-like material through the rotary cutter assembly, the drive maintaining a driving relationship with the anvil roll during movement of the anvil roll between the operative and idle positions.

The principal advantage of the cutter assembly in accordance with the invention resides in its versatility. The cutter assembly is capable to effect a variety of different cutting operations simply by modifying the sequence of actuation of the cutter assembly.

In a preferred embodiment, the anvil roll of the cutter assembly is mounted in floating bearing blocks which allow the anvil roll to be moved in translation relative to the blade carrier roll without affecting the rotational movement of the anvil roll. To raise the anvil roll toward the blade carrier roll and place the cutter assembly in the operative mode, a rotary cam is provided acting on the anvil roll through the intermediary of an idler roller. The anvil roll is brought to the inoperative position under the effect of gravity by displacing the rotary cam to a position in which the anvil roll is allowed to descend.

In a most preferred embodiment, the driving relationship between the prime mover of the cutter assembly and the blade carrier and anvil rolls is maintained irrespective of the position of the anvil roll relative to the blade carrier roll. The blade carrier and anvil rolls are rotated at web speed. As a result, a very accurate cutting action can be performed since the position of the cutting blade on the blade carrier roll with relation to the moving web can be precisely controlled.

As embodied and broadly described herein, the invention also provides a rotary cutter assembly for transversely severing a multi-layered web moving at high speed, the rotary cutter assembly comprising:

a blade carrier roll;

an elongated cutting blade mounted to the blade carrier roll, the elongated blade extending along an axis of rotation of the blade carrier roll;

an anvil roll beneath the blade carrier roll defining therewith a nip through which the multi-layered web is advanced at high speed, the anvil roll having a generally cylindrical and smooth surface for cooperating with the elongated cutting blade for severing the multi-layered web, the anvil roll being capable of controlled movement toward and away the blade carrier roll for selectively enabling and precluding, respectively, occurrence of a cooperating engagement between the elongated blade and the anvil roll when the elongated blade registers with the nip and causing severance of the multi-layered web;

an actuator coupled to the anvil roll for selectively moving the anvil roll toward and away the blade carrier roll; and a drive for rotating the blade carrier and anvil rolls at a tangential speed which generally corresponds to a translational speed of the web-like material through the rotary cutter assembly, the drive maintaining a driving relationship with the anvil roll during movement of the anvil roll toward and away the blade carrier roll.

As embodied and broadly described, the invention further provides a web handling device for forming a continuous multi-form web into a stack, said web handling device comprising:

a folder assembly for laying successive forms of the web in a superposed relationship to form a stack;

a table beneath the folder assembly for receiving and supporting the stack, the table being movable away from the stack at a speed correlated to the build-up rate of the stack in order to prevent the top of the stack from interfering with the folder assembly;

a temporary stack support assembly capable of moving relative to the table between extended and retracted positions, in the extended position the temporary stack support assembly extending between the folder assembly and the table, whereby successive forms of the web are layered in a superposed relationship on the temporary stack support assembly, in the retracted position the temporary stack support assembly being in a spaced apart relationship with the table to allow the folder assembly to lay the web in a folded condition on the table, the temporary stack support assembly being movable toward the extended position and toward the retracted position along different paths of travel; and a stack ejector operating in a timed relationship with the folder assembly for ejecting from the table a completed stack of forms when the temporary stack support assembly is in the extended position.

The web handling device in accordance with the invention is capable of operating at a relatively high speed since the web folding operation is performed without any interruption when a stack of forms is completed and must be ejected from the machine. This is achieved by using the temporary stack support assembly which provides a supporting surface for the incoming folded product while the completed stack is being ejected from the table. When the ejection operation is completed, the temporary stack support assembly is retracted and the folded product in a stacked condition drops on the table where it continues to accumulate. Preferably, the temporary stack support assembly is moved toward the extended position along a descending path which causes the temporary stack support assembly to land on the top of the completed stack, by deflecting downwardly the top sheets of the stack, thereby preventing the temporary stack support to accidentally penetrate within the stack under the top sheet when the latter is slightly raised.

Most preferably, the temporary stack support assembly is movable toward the retracted position along a generally straight path to allow a stack of forms laid on the temporary stack support assembly to drop on the table.

DESCRIPTION OF A PREFERRED EMBODIMENT

The present invention provides a high speed machine for cutting a continuous multi-form web at predetermined lengths and forming the resulting web segments into stacks. The machine can be used with webs constituted by one or more plies of material.

Figure 1:
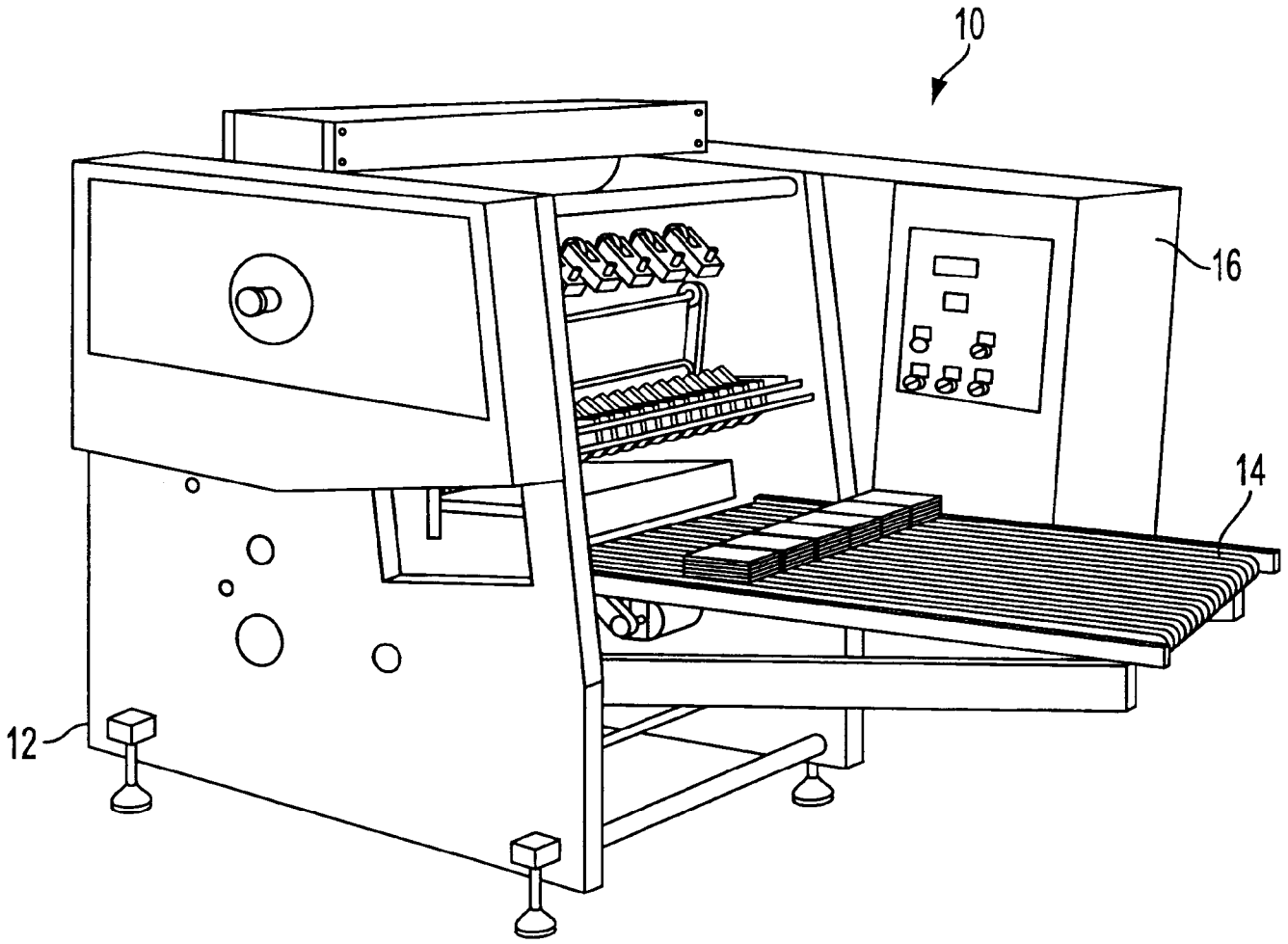
FIG. 1 is a perspective view of a machine for cutting and folding a continuous, multi-form web into stacks, constructed in accordance with the invention.
Figure 2:
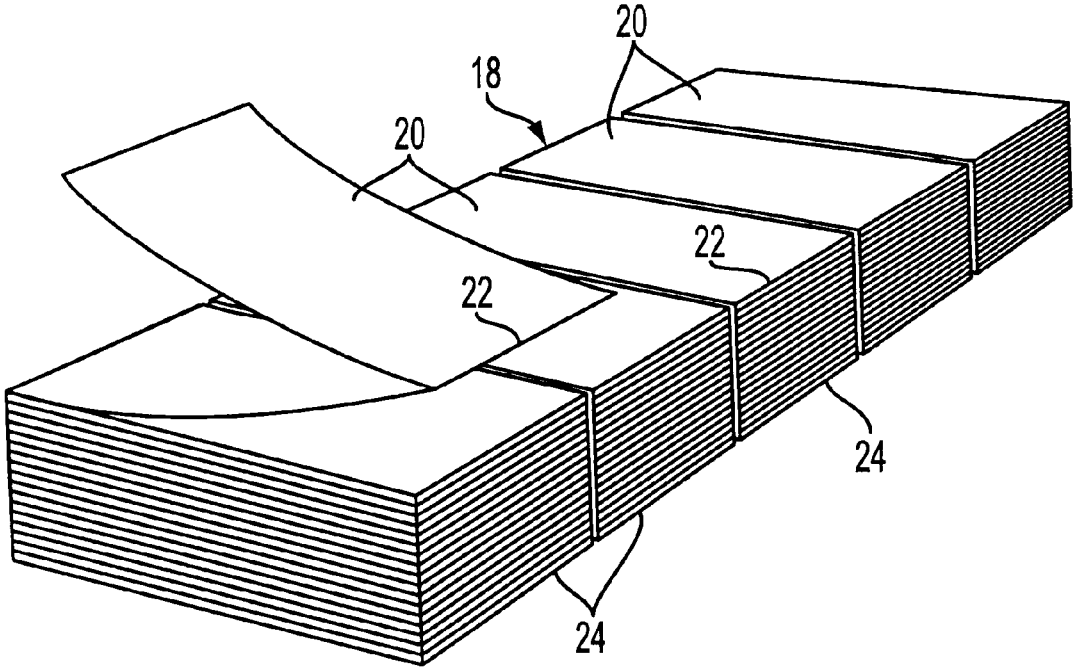
FIG. 2 is a perspective view of a multi-form web in a stacked condition that is produced by the machine shown in FIG. 1.

The machine in accordance with the invention and the resulting product are illustrated in FIGS. 1 and 2. The machine, designated by the reference numeral 10, includes an assembly of rotary members housed in a casing 12 where the various operations on the multi-form web are performed. At the outlet of the machine 10, the web in a stacked condition is delivered on a short run conveyor 14 which transports the material to another processing station such as a packaging unit, for example. The machine 10 is operated by a programmable microprocessor controller (not shown in the drawings). The various controls and the electronics are housed in a cabinet 16 beside the casing 12.

FIG. 2 illustrates in detail the final product delivered by the machine 10. In the example depicted in the drawings, a single layer web 18 constituted by a plurality of forms 20 which are separated from one another by transverse perforations lines 22 is severed in segments containing a predetermined number of forms. Each segment is then folded at the transverse perforations lines 22 in a zigzag fashion to form a stack. Advantageously, the web is slit longitudinally to form several strips which are processed in parallel in order to form a plurality of small stacks 24. The longitudinal slitting of the Web is used when the individual forms 20 are of a relatively small size and the transverse dimension of the web can accommodate more than one form.

Figure 3:
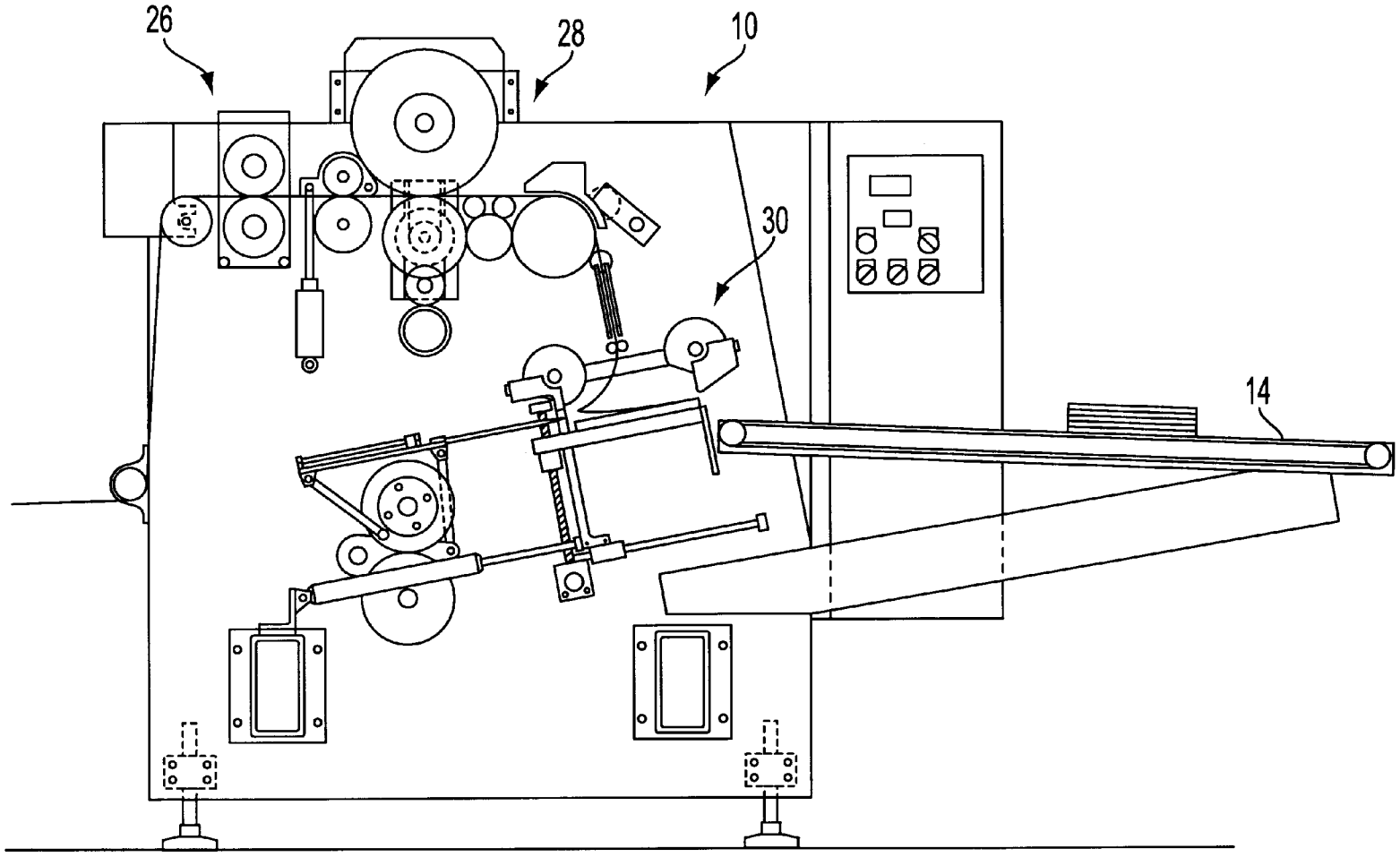
FIG. 3 is a vertical cross-sectional view of the machine shown in FIG. 1.
Figure 4:
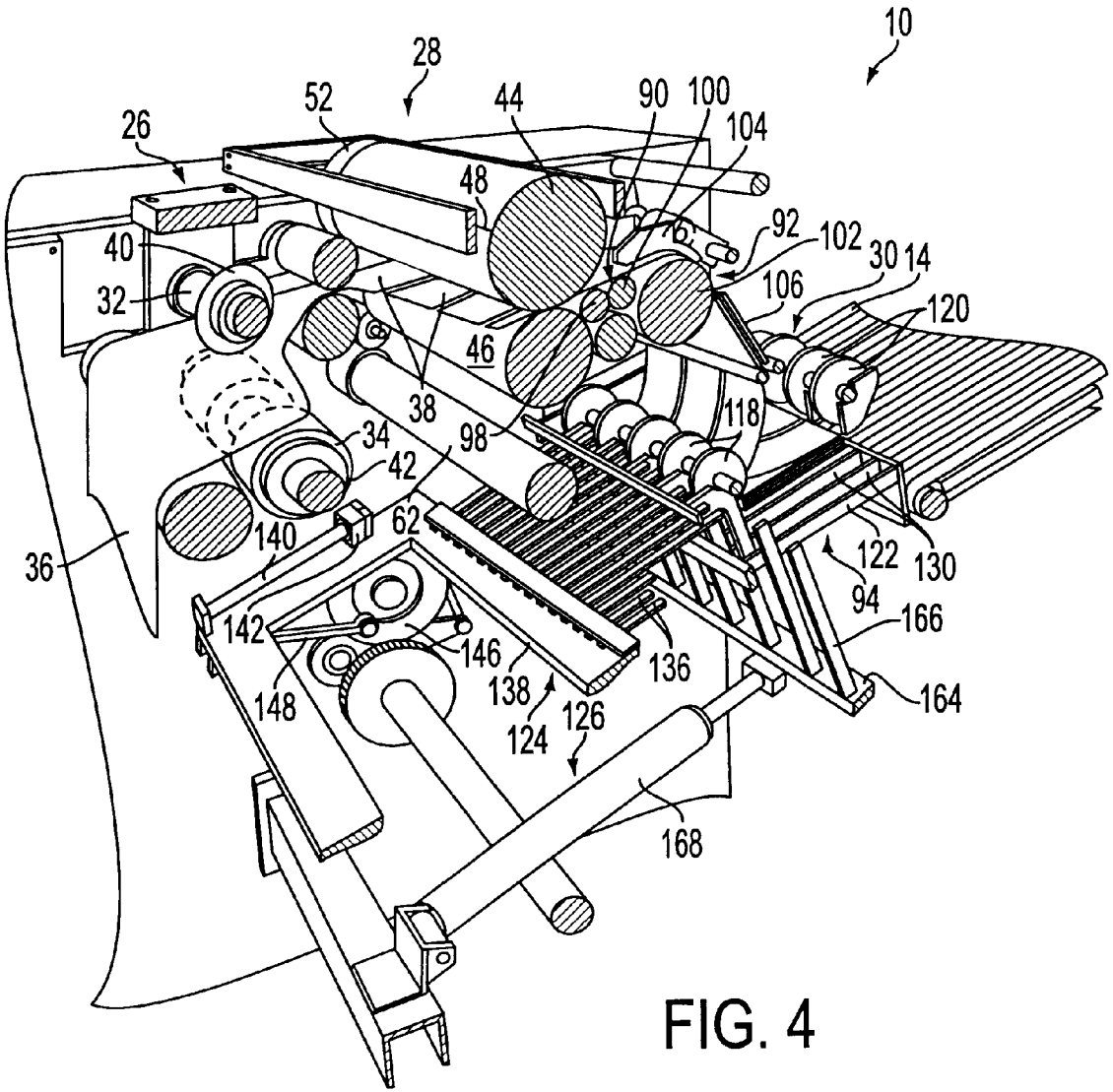
FIG. 4 is an enlarged perspective and fragmentary view of the machine shown in FIG. 1.

With reference to FIGS. 3 and 4, the machine 10 comprises three primary processing stations, namely a slitting assembly 26, a rotary cutting assembly 28 and a folding and stacking assembly 30.

Figure 5:
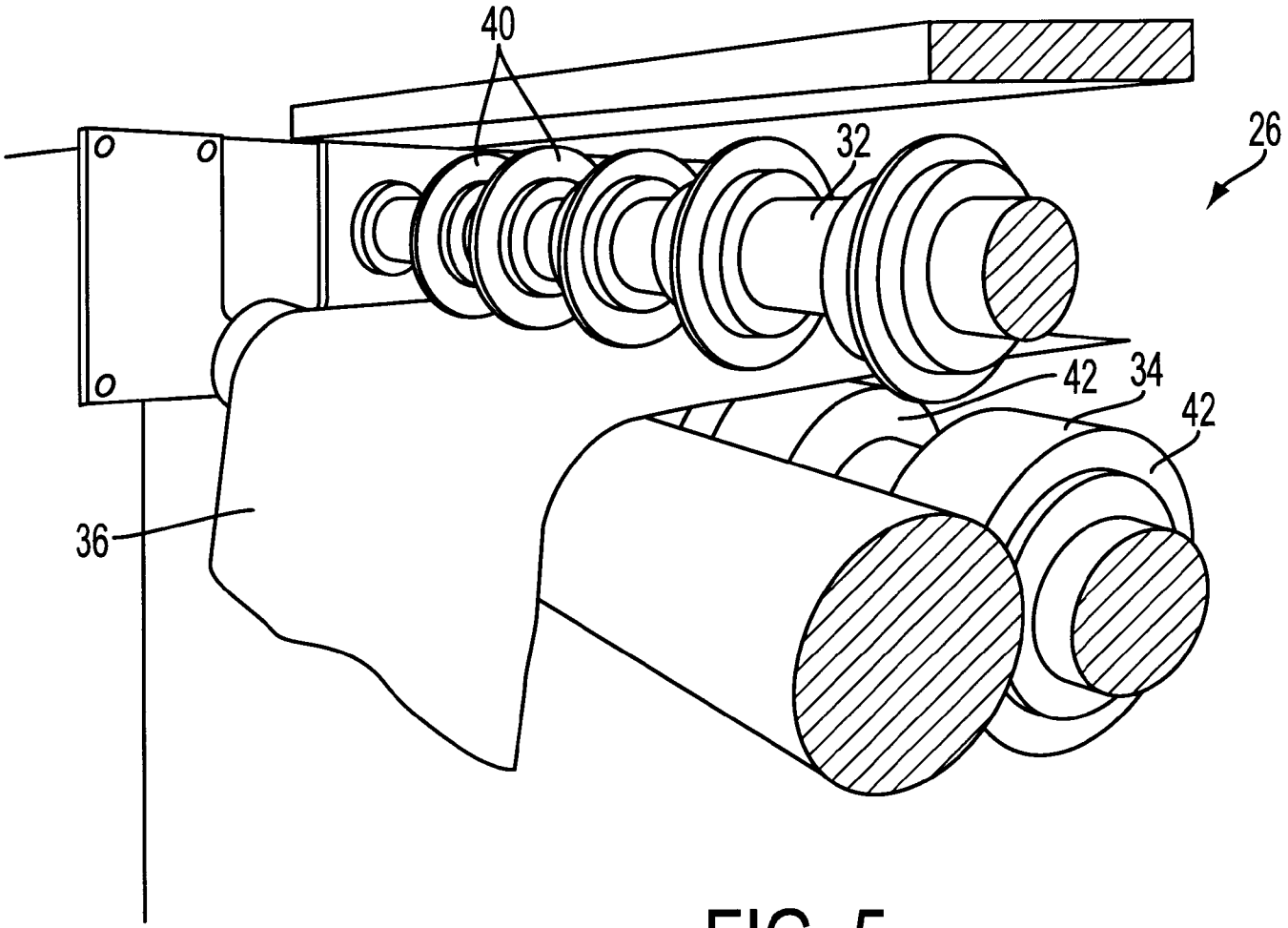
FIG. 5 is a perspective view of a slitting assembly of the machine shown in FIG. 1.

The slitting assembly 26 as best shown in FIGS. 4 and 5 comprises a top roll 32 cooperating with a bottom roll 34 to slit the incoming web 36 longitudinally into parallel strips 38 having an identical width. The slitting assembly 26 is of a well-known construction and does not need to be described in detail herein. Suffice it to say that the top roll 32 comprises circular knives 40 axially spaced apart by a distance corresponding to the desired transverse dimension of the respective strips 38. The circular knives 40 cooperate with cylindrical blocks 42 rigidly mounted on the lower roll 34 to cut the web 36 by shearing action.

The rotary cutting assembly 28 is located downstream of the slitting assembly 26 and it comprises a blade carrier roll 44 cooperating with an anvil roll 46 to transversely sever the strips 38 when the desired number of forms has been counted in order to create a separation between the stacks. Typically, the cut will be made precisely at or as close as possible to a perforation line 22 to maintain the integrity of the forms adjacent this perforation line, thereby reducing waste.

The blade carrier roll 44 is a cylindrical body of metallic material on which are releasably mounted a pair of cutting blades 48 which are diametrically opposed and extend along the longitudinal axis of the blade carrier roll 44. At the end portions of the blade carrier roll 44 are formed enlarged concentric sections 52 (only one being shown in the drawings) between which extend the blades 48. The purpose of the enlarged portions 52 is to establish a minimum gap between the blade carrier roll 44 and the anvil roll 46 as it will be described hereinafter. In practice, this minimum gap will correspond to the projection height of each blade 48 from the cylindrical surface of the blade carrier roll 44. The system for mounting the blades 48 to the blade carrier roll 44 is not illustrated herein because it is of conventional construction. Suffice it to say that it is constituted by a mechanical clamp in which the blades 48 are fitted and secured by bolts. When either one of the blades is worn out or need servicing, the bolts a re released to remove the blade.

The anvil roll 46 is a cylindrical body having a constant diameter from one end to the other,, which cooperates with the blades 48 in order to effect the cut of the strips 38. During the cooperating engagement between the blade carrier and anvil rolls, the concentric sections 52 are in rolling contact with the anvil roll 46, preventing the anvil roll 46 from extending too close to the blade carrier roll 44 which could damage the blades 48.

Figure 6:
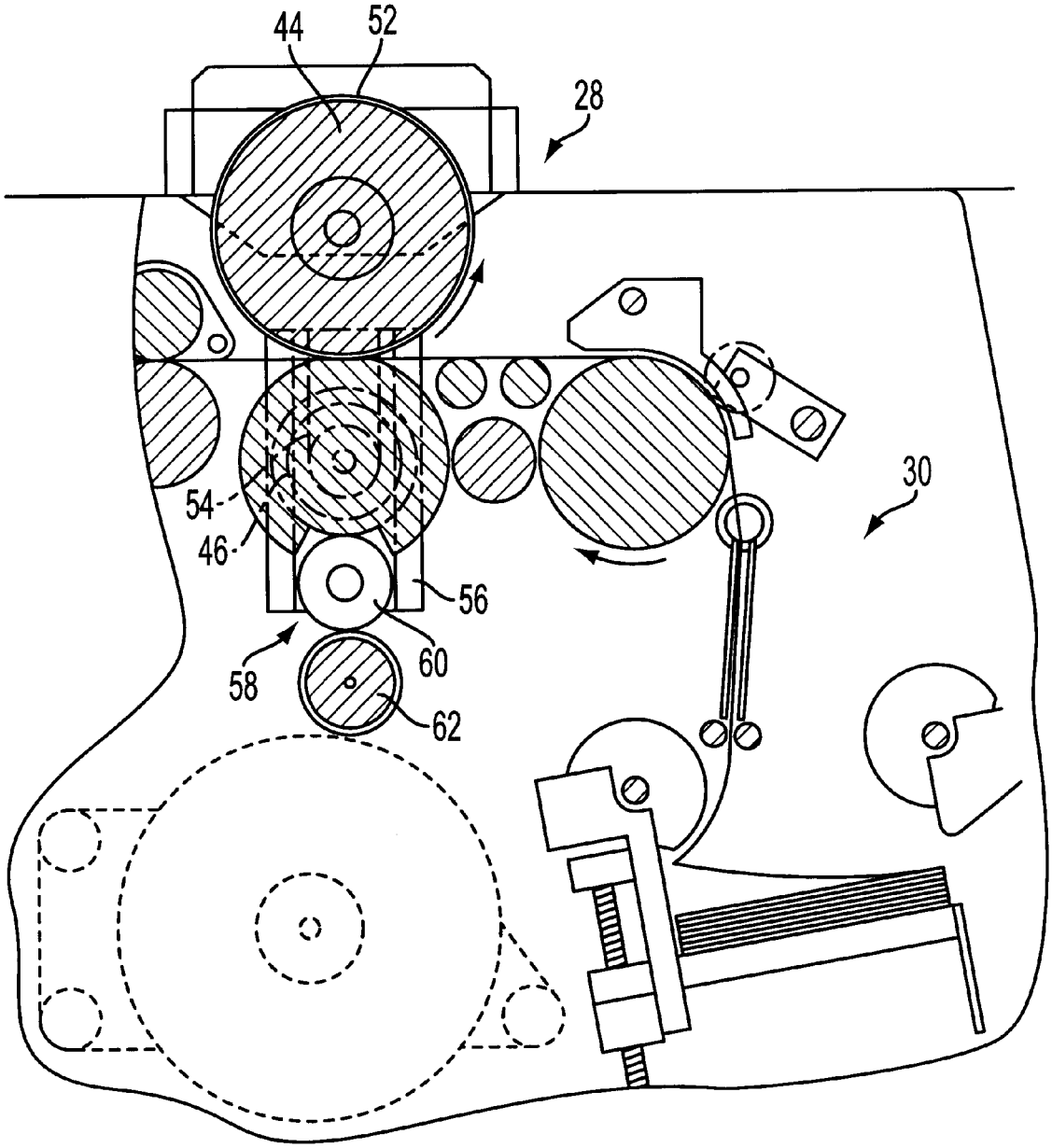
FIG. 6 is a side elevational schematical view of a rotary cutter assembly of the machine shown in FIG. 1.

With reference to FIG. 6, the journals of the anvil roll 46 are rotatably mounted in bearing blocks 54 which are slidingly mounted in saddles 56 formed in the frame of the machine, which receive the opposite extremities of the anvil roll 46. By this arrangement, the anvil roll 46 is free to rotate about its longitudinal axis while being capable o f translational movement relative the blade carrier roll 44. This characteristic allows to set the rotary cutter assembly 28 in operative and idle modes as it will be explained hereinafter.

The upward movement of the anvil roll 46, i.e. toward the blade carrier roll 44 is achieved by an actuator assembly 58 comprising a pair of idler rollers 60 (only one being shown in FIG. 6) rotatably mounted to the respective bearing blocks 54 and being in rolling contact with a rotary cam. Upon rotation of the rotary cam 62 the idler rollers 60, the bearing blocks 54 and the anvil roll 46 are caused to move up to follow the cam profile. The downward movement of the anvil roll 46, the bearing blocks 54 and of the idler rollers 60 is made under the effect of gravity when the cam 62 is rotated to a position allowing the floating assembly to descend.

The blade carrier roll 44 and the anvil roll 46 are rotated in opposite directions at web speed by a drive system best shown in FIGS. 7, 8*a*, 8*b*, 8*c* and 8*d*.

Helical cut gears 64 and 66 rigidly mounted to the blade carrier roll 44 and to the anvil roll 46 respectively, are meshed together, whereby rotating movement communicated to one of these gears is automatically transferred to the other gear. The gear 66 meshes with a helical cut drive gear 68 mounted on a common shaft 69 with a straight cut gear 70. The characteristic of the gears 68 and 70 is that they are locked against relative rotational movement. However, shaft 69 along with gears 68 and 70 are capable of axial displacement. This is achieved by rigidly mounting the helical cut drive gear 68 to the shaft which is of square cross-section. The straight cut gear 70 has a central opening whose shape is complementary to the cross-sectional shape of the shaft which allows the straight cut gear 70 to slide longitudinally on the shaft but prevents it from rotating thereon. Straight cut gear 70 is preferably fixed to shaft 69 and will move axially, along with gear 68, when shaft 69 moves axially. Other mounting means will be readily apparent to a one skilled in the art; for example gear 68 may be keyed to shaft 69.

A straight cut gear 72 meshes with the gear 70, and also meshes with a straight cut gear 74 which in turn meshes with a main gear 76 connected to the input shaft of an electronically controlled clutch 78. The output shaft of the clutch 78 is mounted to a ring gear 80 which is coaxial with the main gear 76 and is caused to rotate only when the clutch 78 is engaged.

The gear 74 is an idler gear rotatably mounted on a shaft on which is rigidly mounted a gear 82. The gear 82 meshes with the ring gear 80 and it is used to drive the rotary cam 62 which is also rigidly mounted to the shaft supporting the gears 82 and 74.

From the above it will be appreciated that upon rotation of the main gear 76, gears 74, 72, 70 and 68 are caused to rotate for driving the gears 66 and 64 which turn the anvil roll 46 and blade carrier roll 44 respectively. The various gear diameters are selected so as to rotate the anvil roll 46 and the blade carrier roll 44 at a tangential speed corresponding to the speed of the web.

If it is desired to operate the rotary cam 62, the electronic clutch 78 is momentarily engaged to lock the ring gear 80 to the main gear 76, thereby causing rotation of the gear 82 and correspondingly of the rotary cam 62. The rotation of the cam 62 causes the anvil roll 46 to move upwardly, toward the blade carrier roll 44 in order to set the cutter assembly 28 in the operative mode.

During the upward or the downward movement of the anvil roll 46, the gears 66 and 64 and the drive gear 68 remain engaged in order to continuously rotate the blade carrier roll 44 and the anvil roll 46 at correct speed. The vertical movement between the anvil roll 46 and the blade carrier roll 44 is made possible by using gears 66 and 64 which permit a sufficient radial free-play therebetween. That free-play determines the permissible translatory movement of the anvil roll 46 to switch between operative and idle modes.

Figure 7:
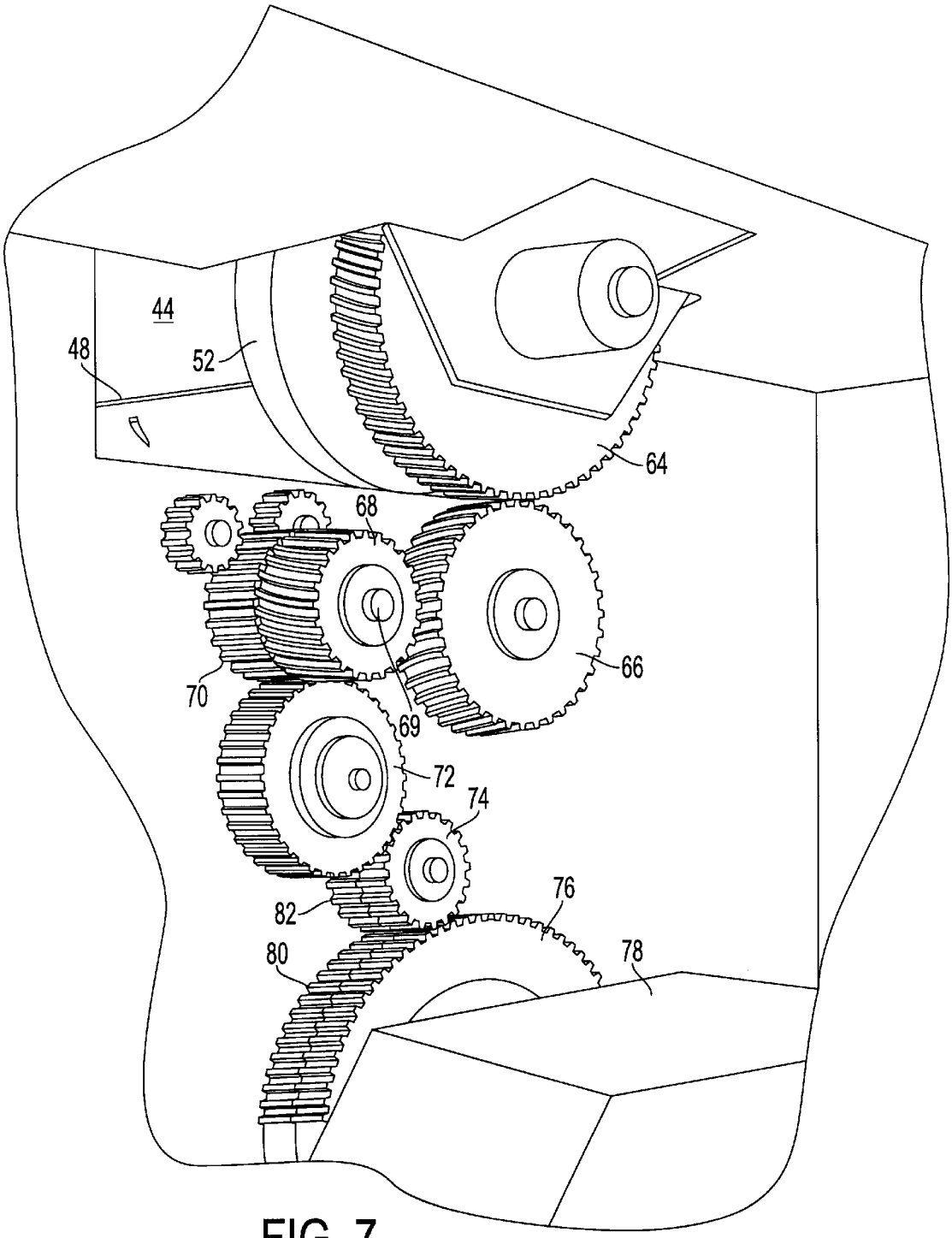
FIG. 7 is an enlarged view of the drive system of the rotary cutter assembly.
Figure 8A:
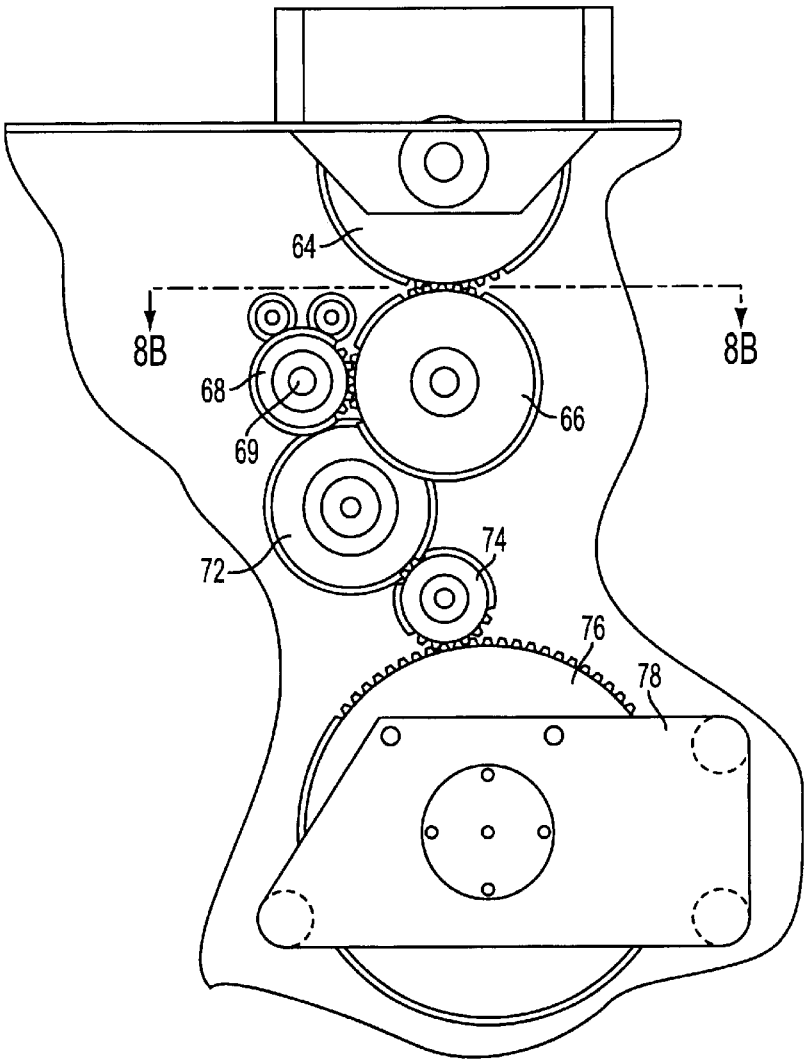
FIG. 8*a* is a side elevational view of the drive system of the cutter assembly.
Figure 8B:
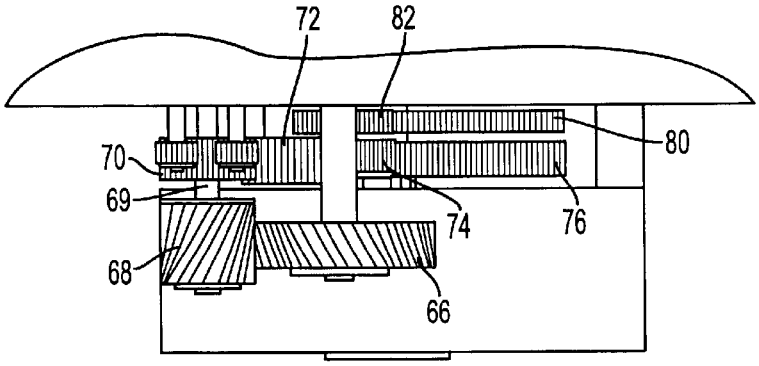
FIG. 8*b* is a sectional view taken along lines 8*b*—8*b* in 8*a*.
Figure 8C:
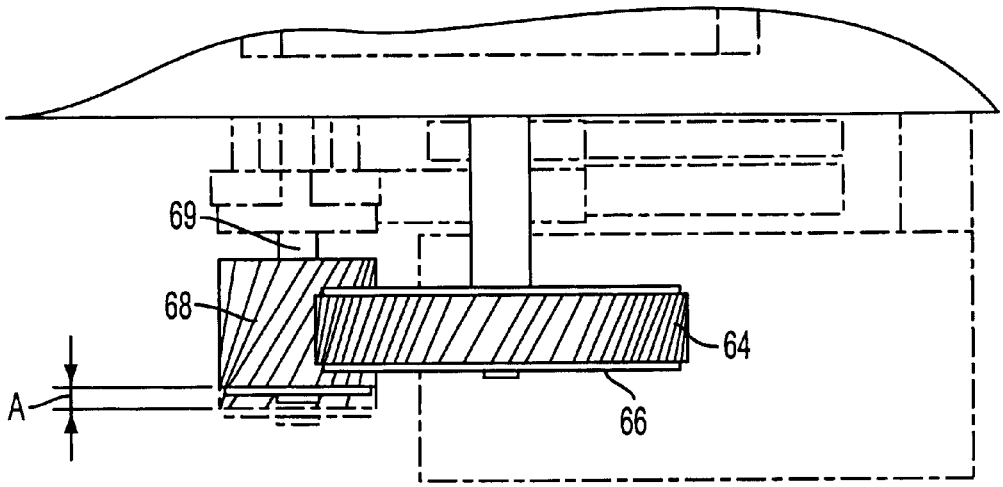
FIG. 8*c* is a fragmentary top plan view of the drive system of the rotary cutter assembly illustrating a gear movement to adjust the timing of a blade carrier roll.
Figure 8D:
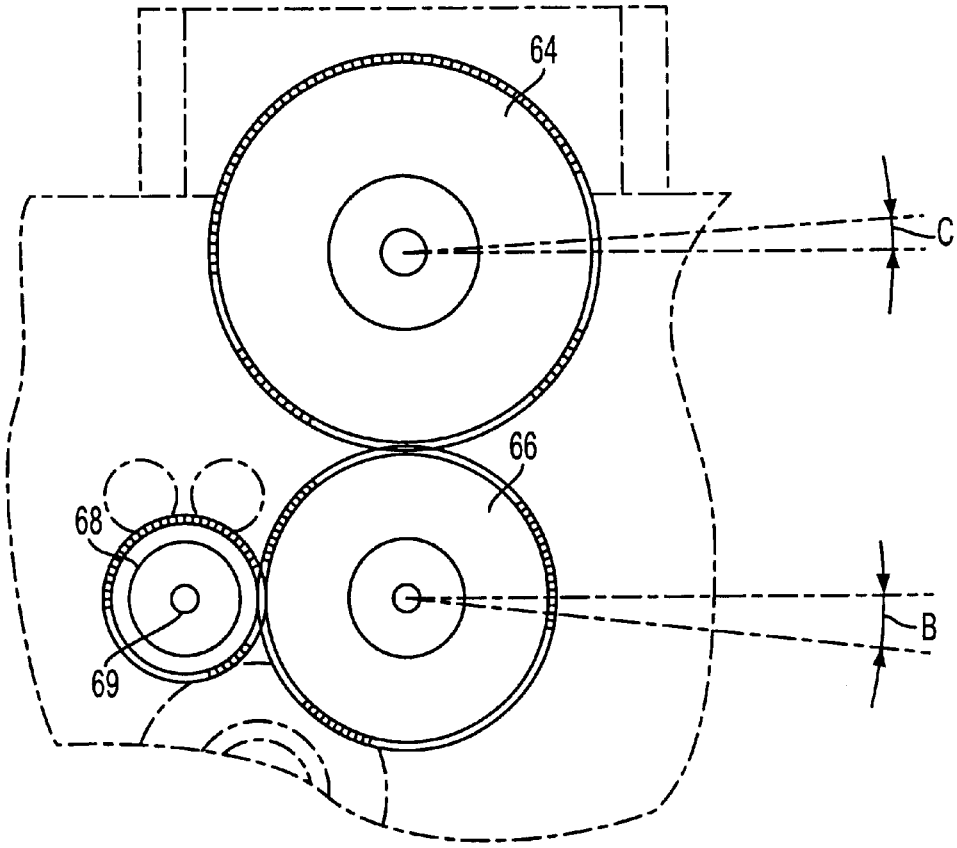
FIG. 8*d* is a side elevational view of the drive system of the rotary cutter assembly illustrating the movement of the blade carrier roll and of an anvil roll during a timing adjustment.

During the upward and downward movement of the anvil roll 46 a certain speed variation of this roll occurs due to the fact that the circumferential free-play between the gears 66 and 68 is insufficient to allow a translatory movement of the anvil roll 46 without any rotation thereof. Considering that the gear 66, as shown in FIG. 7, rotates in a counter clockwise direction, by raising the anvil roll 46 upwards would necessarily produce a slight increase of speed during this upward movement. Similarly, when the anvil roll 46 travels downward, it decelerates slighty with respect to its nominal speed during the downward movement. These speed variations cause a certain angular shift between the anvil roll 46 and the blade carrier roll 44 which, however, do not affect the accuracy of the cut since the anvil roll is smooth surfaced and the blade 48 can effect a cut against any point of this surface.

Due to the fact that the drive gear 68 and the gears 66 and 64 are of the helical type (i.e. having teeth extending obliquely relative to the gear rotation axis), axially displacing shaft 69 and gear 68, while straight cut gear 70 remains meshed with gear 72 during the short axial displacement of shaft 69 and gear 70 preventing rotation of gear 68, causes a controlled rotation of helical gear 66 and thus gear 64. Advantageously, this arrangement can be used to adjust the timing of the blade carrier roll 44, in other words, setting the angular position of the blade carrier roll 44 with respect to the main gear 76.

This characteristic is best illustrated in FIGS. 8*a* to 8*d*. By displacing the drive gear 68 axially over a distance A, gear 66 is rotated by an arc of circle having a length B while gear 64 turns by an arc of circle having a length C. Due to the different diameters of the gears 66 and 64, arc B is greater than arc C.

The ability of the drive gear 68 to move axially with the straight cut gear 70 allows performing timing adjustment without inducing any rotation in the rest of the system drive. A practical set-up for displacing the gear 68 axially includes a simple mechanical knob (not shown in drawings) which is rotated to act on the drive shaft 69 of the gears 68 and 70 in order to axially slide this shaft in its bearings. This sliding movement does not disengage the straight cut gear 70 which remains meshed with gear 72. Gears 70 and 72 maintain the angular integrity of shaft 69 during this axial movement. Shaft 69 remains in phase with gears 70 and 72, and timing adjustment is caused by the helical teeth on gear 68 in engagement with helical gear 66. Thus the amount of timing adjustment is dependent on the linear movement of shaft 69 in its longitudinal axis.

The rotary cutter assembly 28 is extremely advantageous as it can be activated to effect a cut only when desired. In order to sever the strips 38, two conditions must be met. Firstly, the anvil roll 46 must be in the operative position (raised position). Secondly, a blade 48 must register with the nip between the blade carrier roll 44 and the anvil roll 46. During such registration, the blade 48 presses the web material against the surface of the anvil roll 46 to effect the cut.

The rotary cutter assembly 28 is placed in the idle mode by lowering the anvil roll 46 in which case the gap between the anvil roll 46 and the blade carrier roll 44 is sufficiently wide to allow the web material to yield away upon engagement by a blade 48, thereby prevent a cut to occur.

Figure 9:
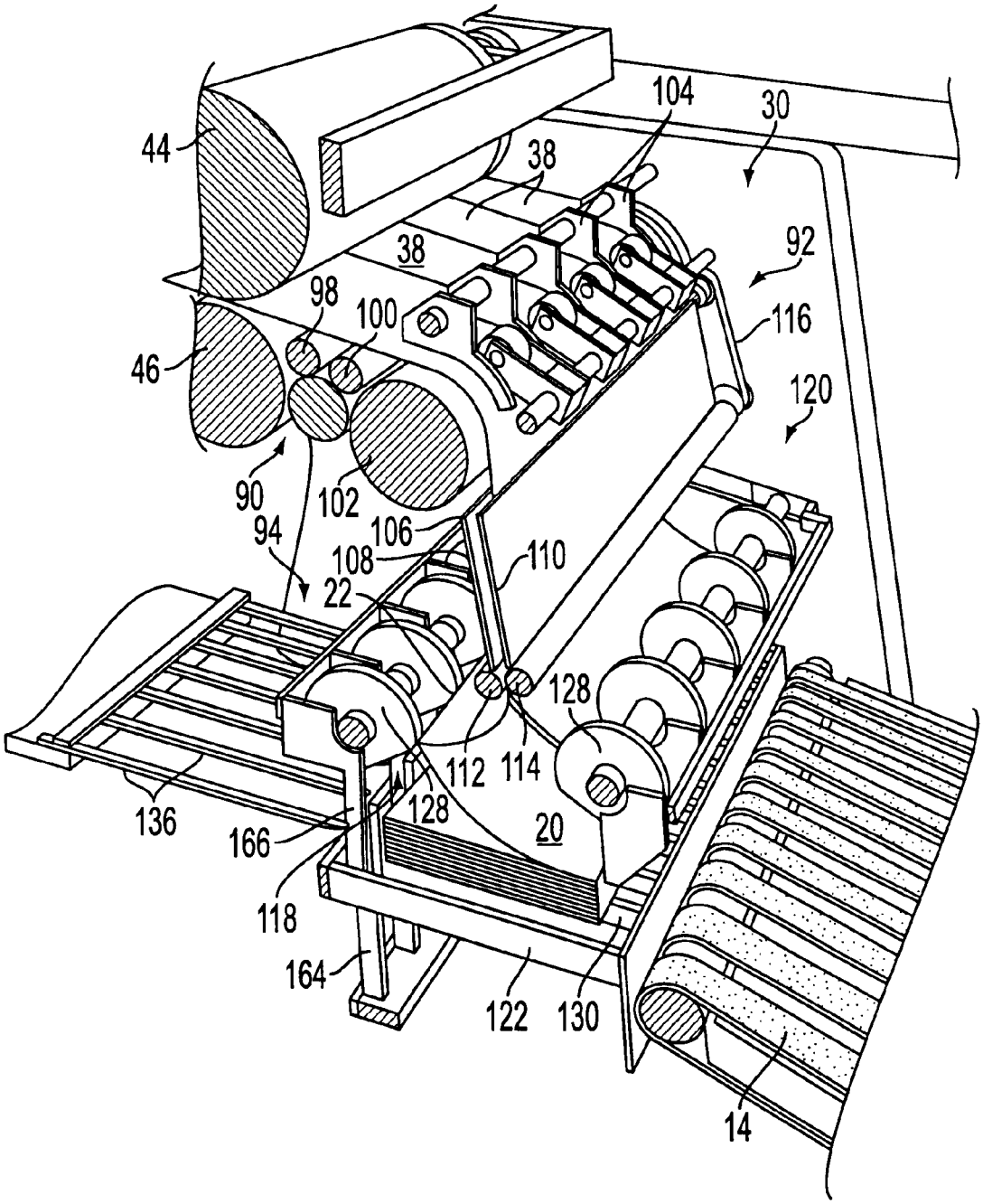
FIG. 9 is a fragmentary perspective view of a folder and stacker assembly of the machine shown in FIG. 1.

The overall configuration of the folding and stacking assembly 30, located downstream of the rotary cutter 28, is best shown in FIGS. 4 and 9. The folding and stacking assembly 30 comprises a feed unit 90 receiving the slitted web from the rotary cutter assembly 28 an d driving the web into a folder unit 92 which lays the web in a zigzag configuration on a stacker assembly 94 positively folding the strips 38 at the perforation lines 22 to form simultaneously the strip 38 into independent, transversely aligned stacks.

The principal characteristic and advantage of the folder and stacker assembly 30 is its ability of ejecting completed stacks without interrupting the folding operation of the web, thereby allowing to operate the machine 10 at a relatively high speed.

More specifically, the feed unit 90 comprises a pair of rolls 98 and 100 which support the web and rotate to feed the web to a guide roller 102. The guide roller 102 is rotated at a tangential speed which exceeds the nominal web speed of the machine 10 in order to space the web segment severed by the rotary cutting assembly 28 which is driven at overspeed by the feed unit 90, from the main web run, upstream of this web segment, which advances at nominal speed.

Rotary guide fingers 104 urge the web against the roll 102 which gently bends the web downwardly while advancing same into a swing chute which oscillates back and forth in a timed relationship with the web feed rate in order to lay the web in a zigzag fashion. The concept of stacking a multiform web by using a swing chute is old in the art. For example the U.S. Pat. No. 5,087,023 which has been issued to the Standard Register Company on Feb. 11, 1992 describes a swing chute of this kind. The entire disclosure of this patent is incorporated herein by reference.

The swing chute configuration which has been found most satisfactory includes a pair of guide plates 108 and 110 which are parallel and spaced apart by a distance sufficient to adequately guide the web without imposing too much resistance to its passage. At the lower ends of the plates 108 and 110 are mounted a pair of pinch rollers 112 and 114 advancing the web through the swing chute 106 by frictional contact. The pinch rollers 112 and 114 are driven by cogged belts 116.

The stacker unit 94 which receives the folded product from the swing chute 106 comprises a pair of knockdown roller assemblies 118 and 120 which positively fold the incoming web about the perforation lines 22 to build-up a stack of forms on a variable height table 122. The stacker unit 94 also comprises a temporary stack support assembly 124 whose overall configuration is best shown in FIG. 4 and whose purpose is to momentarily retain the incoming folded product when a completed stack on the table 122 is being ejected from the machine. The removal of the stack is performed by an ejector assembly designated comprehensively by the reference numeral 126 in FIG. 4.

The structure and operation of the knockdown roller assemblies 118 and 120 will not be described herein because these devices are well-known in the art. Suffice it to say that each knockdown roller assembly comprises a plurality of disks 128 which are rigidly mounted on a common rotary shaft in an axially spaced part relationship. Each disk 128 is in the form of a circular body having a truncated portion to clear the swinging path of the chute 106 and prevent interference therewith.

Figure 10:
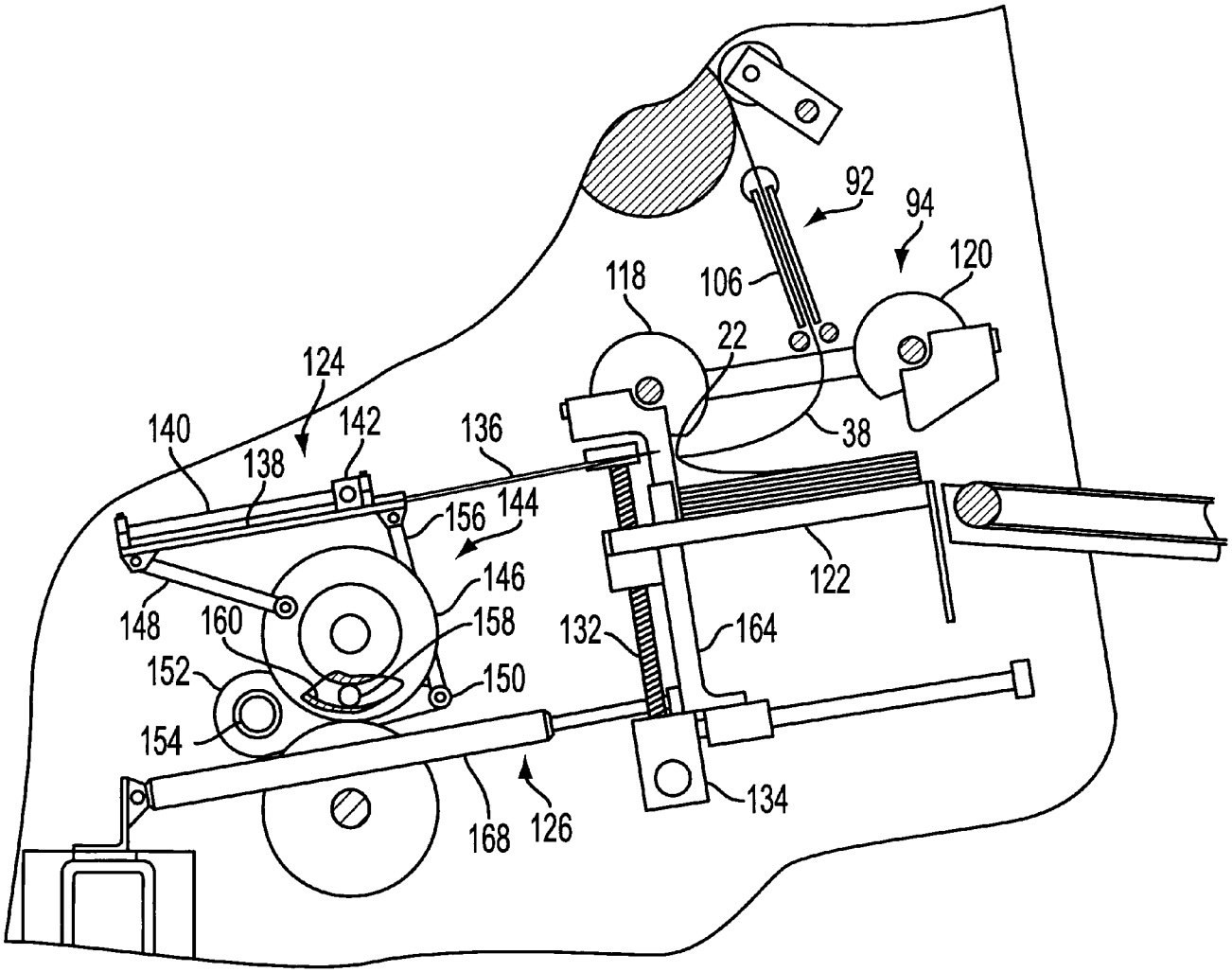
FIGS. 10 to 14 are side elevational views of the folder and stacker assembly of the apparatus shown in FIG. 1 in different operative positions.
Figure 11:
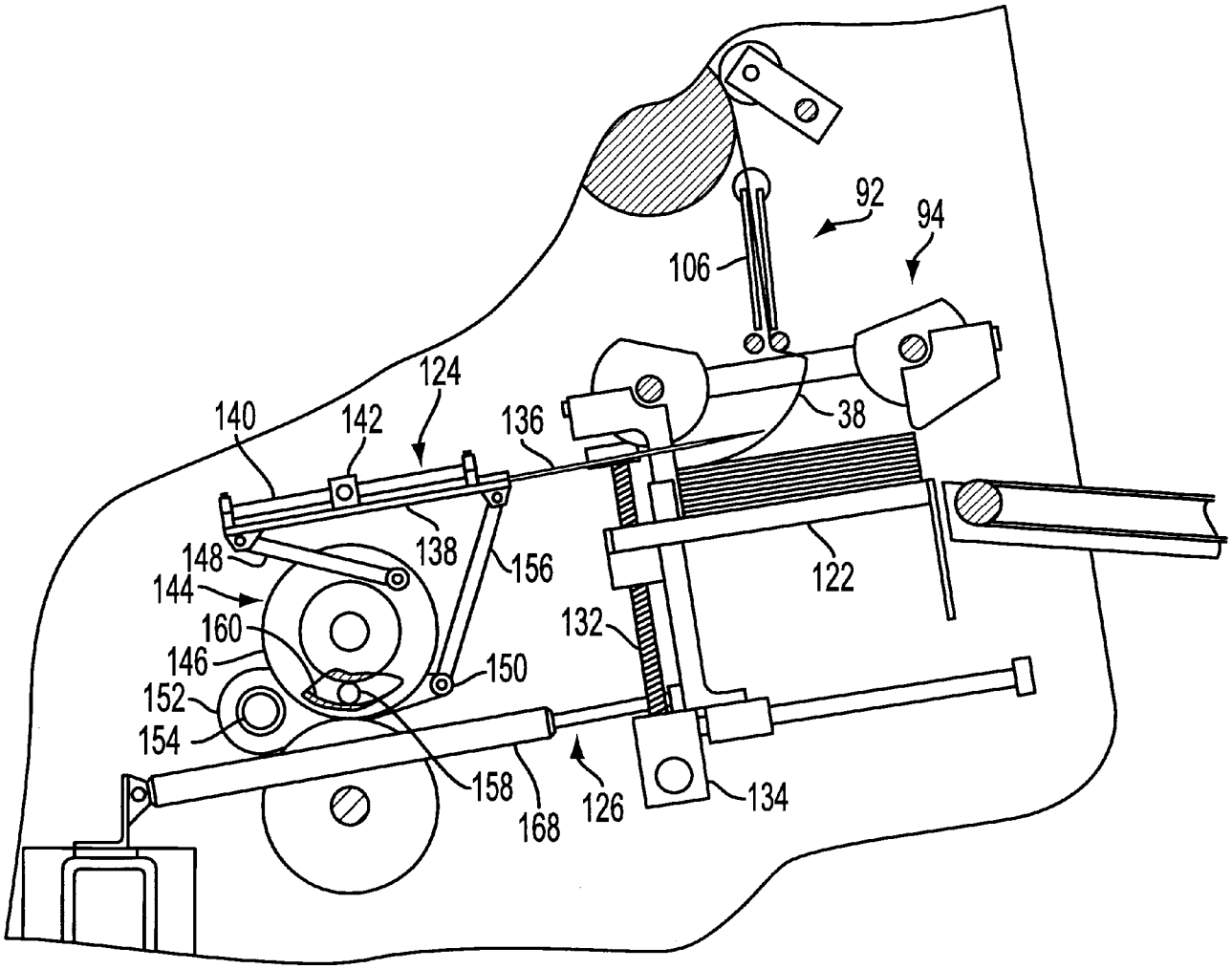

The structure of the variable height table 122 will now be described in detail with reference to FIGS. 9 and 10. The table 122 comprises a relatively flat supporting surface constituted by a plurality of parallel bars 130 which are arranged in a spaced apart relationship. The table 122 is supported on a pair of threaded shanks 132 (only one being shown in the drawings). It will be appreciated that by rotating the shanks 132 the table 122 is caused to move vertically. Shanks 132 are rotated by motors 134 (only one being shown in the drawings).

The purpose of this arrangement is to maintain the top of the stack in the same horizontal position in order to allow the knockdown roller assemblies 118 and 120 to efficiently fold the web at the perforation lines 22. This is achieved by gradually lowering the table to compensate for the increasing stack height. Without such feature, it will appreciated that as the stack builds-up, the top of the stack will eventually interfere with the operation of the folder unit 92 which will jam the machine.

The structure of the temporary stack support assembly 124 will now be described with relation to FIGS. 4 and 10 to 15. The temporary stack holder assembly 124 comprises a plurality of parallel and spaced apart projecting fingers 136 which register with respective spaces defined between the disks 128 of the knockdown roller assembly 118. The fingers 136 are connected to a rectangular frame 138 which is slidingly mounted on guide bars 140 (only one being shown in the drawings) whose extremities are secured in blocks 142 pivotally mounted to the frame of the machine. This arrangement allows the frame 138 and the fingers 136 to move relative to the table 122 at various angular positions in order to achieve a non linear path of travel.

The temporary stack support assembly 124 also comprises a drive system 144 for moving the fingers 136 between an extended and a retracted position relative to the table 122 along different paths of travel. The drive 144 includes a rotary disk 146 in a driven relationship with the prime mover of the machine 10. A linkage 148 has one extremity pivotally mounted to the disk 146 near its periphery and an opposite end pivotally connected to the rear edge of the rectangular frame 138. By this arrangement, a continuous rotation of the disk 146 will cause the fingers 136 and the frame 138 to reciprocate across the web path between the folder unit 92 and the table 122.

Figure 15:
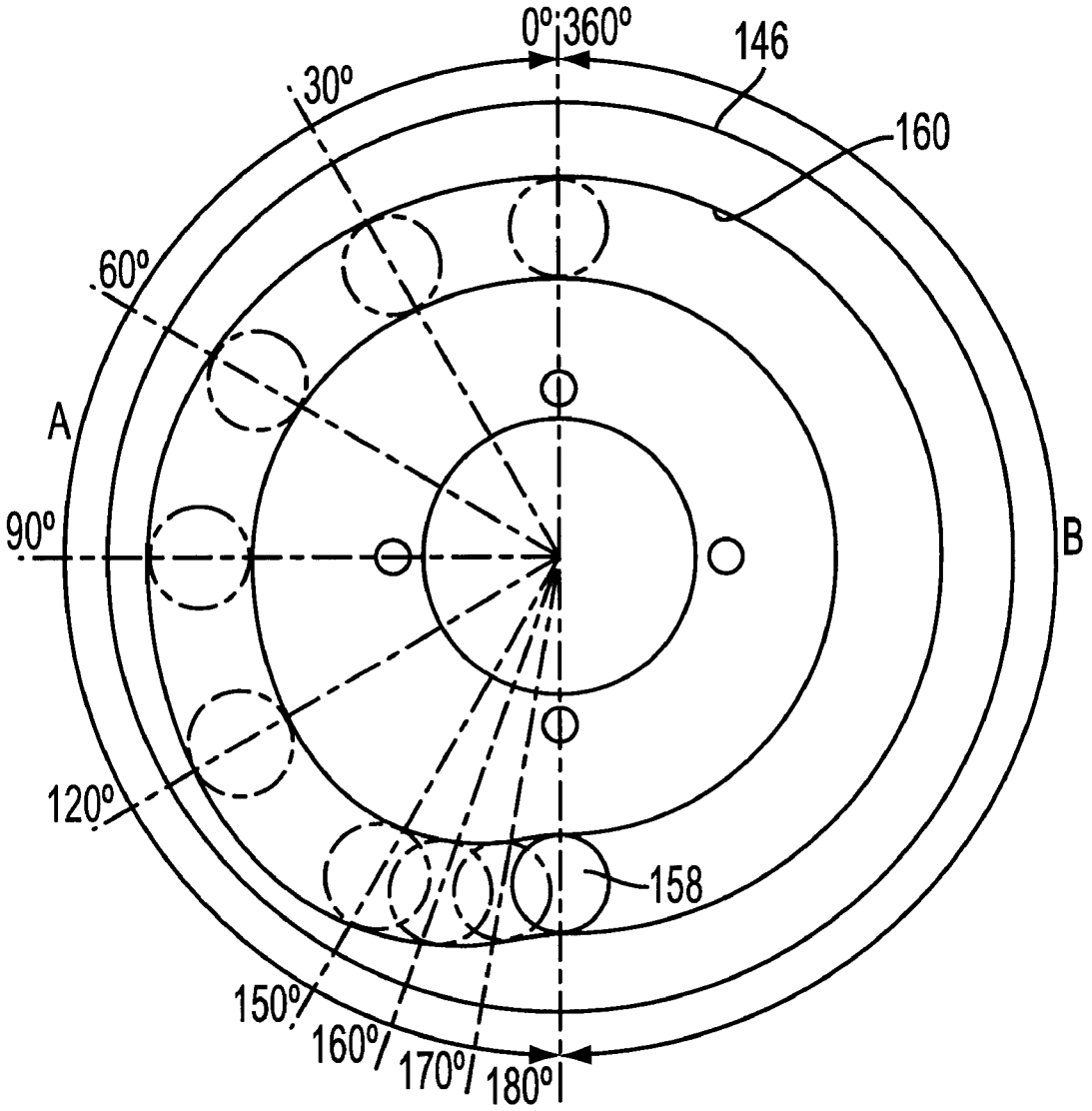
FIG. 15 is an elevational view of a rotary cam of the folder and stacker assembly in accordance with the invention.

To dynamically control the angular position of the fingers 136 during their displacement relative the table 122, a linkage 150 is provided comprising a lever 152 pivotally mounted at an end 154 and a link member 156 pivotally connected between the other extremity of the lever 152 and the frame 138. On the lever 152 is formed a projecting pin 158 engaging a groove 160 formed in the disk 146, having a non-circular configuration and acting as a cam surface to vary the angular position of the lever 152 and consequently the inclination of the fingers 136 as the disk 146 rotates. FIG. 15 best illustrates the cam profile of the groove 160.

The ejector assembly 126 comprises an ejector frame 164 constituted by a plurality of upwardly extending fingers 166 which are parallel and in a spaced apart relationship (this feature is best shown in FIGS. 4 and 9). The fingers 166 register with respective openings defined between the bars 130 of the table 122, thereby allowing the ejector frame 164 to travel across the table, irrespective of the vertical position at which the table 122 is located. The ejector frame 164 is driven across the table 122 by an actuator 168 in the form of a pneumatic piston-cylinder assembly.

The detailed operation of the folder unit 92 and of the stacker unit 94 will now be described with relation to FIGS. 10 to 17. The incoming web in the form of parallel strips 38 is laid in a zigzag configuration on the table 122 as a result of the oscillating movement of the swing chute 106. The rotation of the knockdown assemblies 118 and 120 positively folds the forms at the perforation lines 22 for compacting the stack supported on the table 122. The latter is continuously lowered at a speed correlated with the feed rate of the incoming folded product in order to maintain the top of the stack at a constant level. As previously mentioned, the lowering of the table 122 is achieved by a controlled rotation of the threaded shanks 132.

Figure 16:
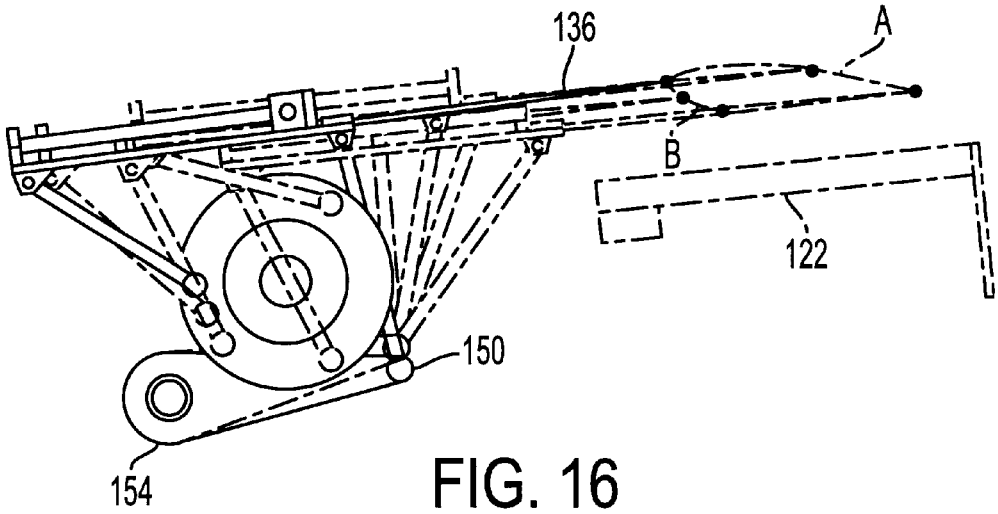
FIG. 16 is a side elevational schematical view of a temporary stack support assembly of the folder and stacker assembly in various operative positions.
Figure 17:
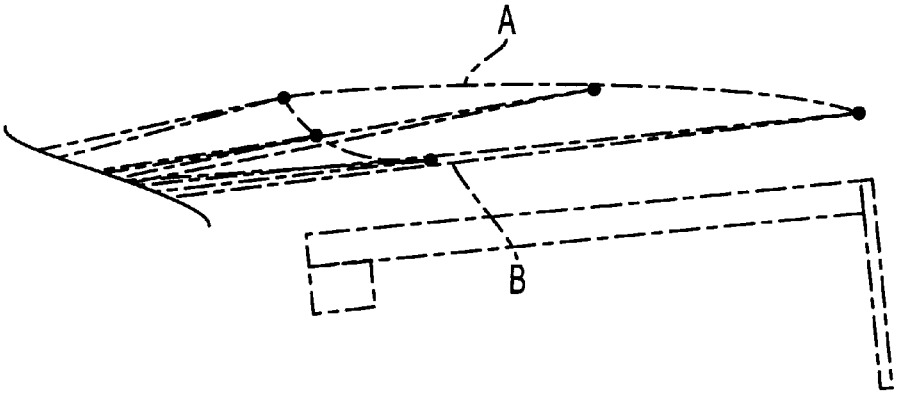
FIG. 17 is an enlarged schematical view of the temporary stack support assembly illustrating its path of travel between the extended and the retracted position thereof.

When the desired number of a forms have been laid on the table 122, in other words when the stack is completed, the temporary stack support assembly 124 is actuated for extending the fingers 136 between the table 122 and the folder unit 92. This is accomplished by rotating the disk 146 which causes the frame 138 and the fingers 136 to move from the retracted position toward the extended position through the spaces between the disks 128 of the knockdown assembly 118. During this movement, the lever 152 follows a 180° sector of the cam profile identified by A in FIG. 15 and dynamically varies the angular position of the fingers 136 through the intermediary of the link member 156. The cam profile is such as to impart to the fingers 136 an arcuate descending path which is best shown in FIGS. 16 and 17. The trajectory of the fingers 136 toward the extended position is shown by the phantom line designated A.

The descending movement of the fingers 136 is a highly desirable feature because it significantly limits the risks of an incorrect engagement between the fingers 136 and the outgoing stack such as for example when the fingers 136 would slip into the stack instead of landing on the top thereof. In practice, the top of the stack is rarely perfectly flat as the top sheet which is retained only at one end to the rest of the stack may be slightly raised or subject to flutter due to the presence of air currents in the machine. Accordingly, if the fingers 136 are advanced along a horizontal path of travel there is significant risk of misengaging the stack. In contrast, a downward movement of the fingers 136 gradually deflects the top sheet toward the stack while moving across the table 122, thereby preventing misengagement.

Figure 12:
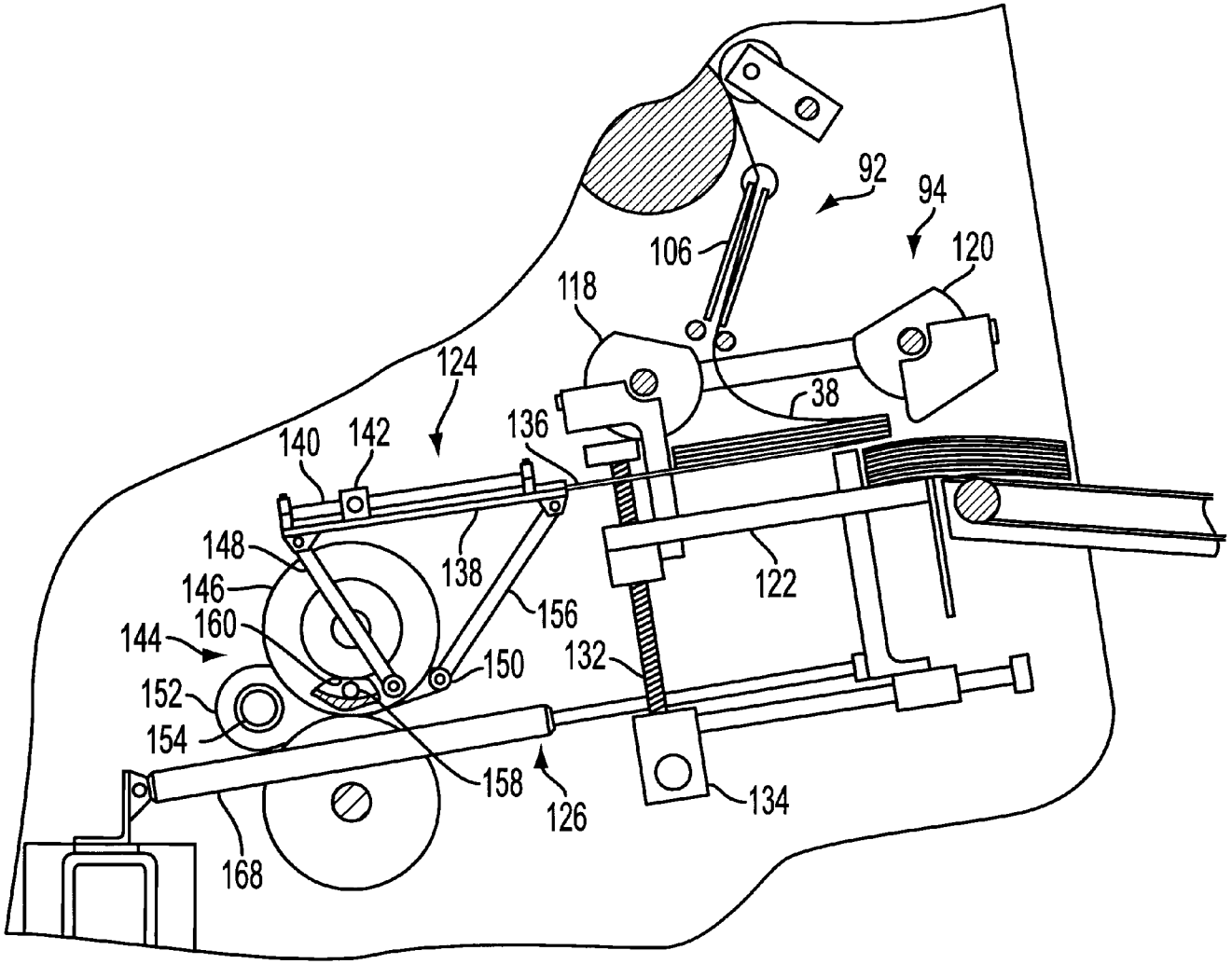
Figure 13:
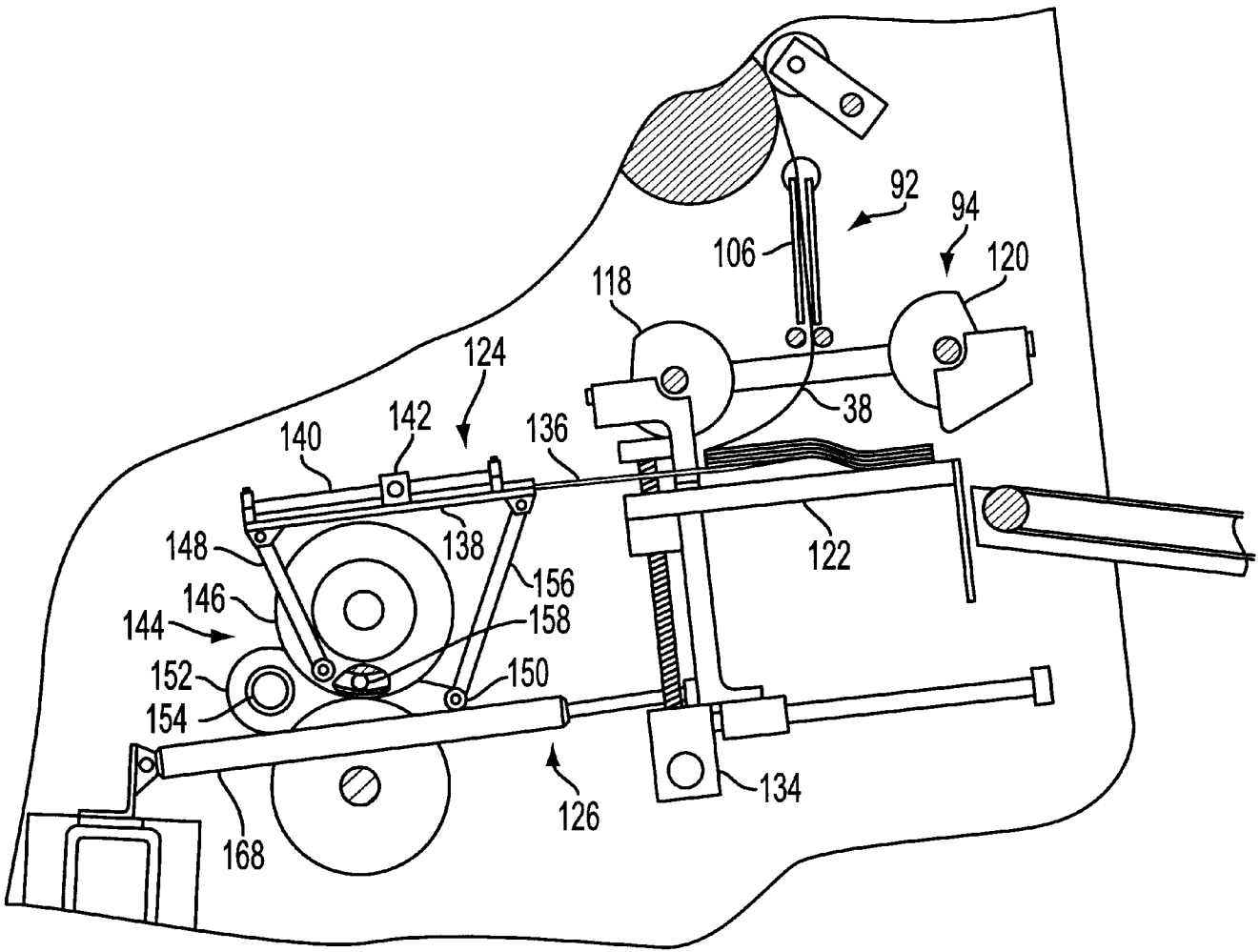
Figure 14:
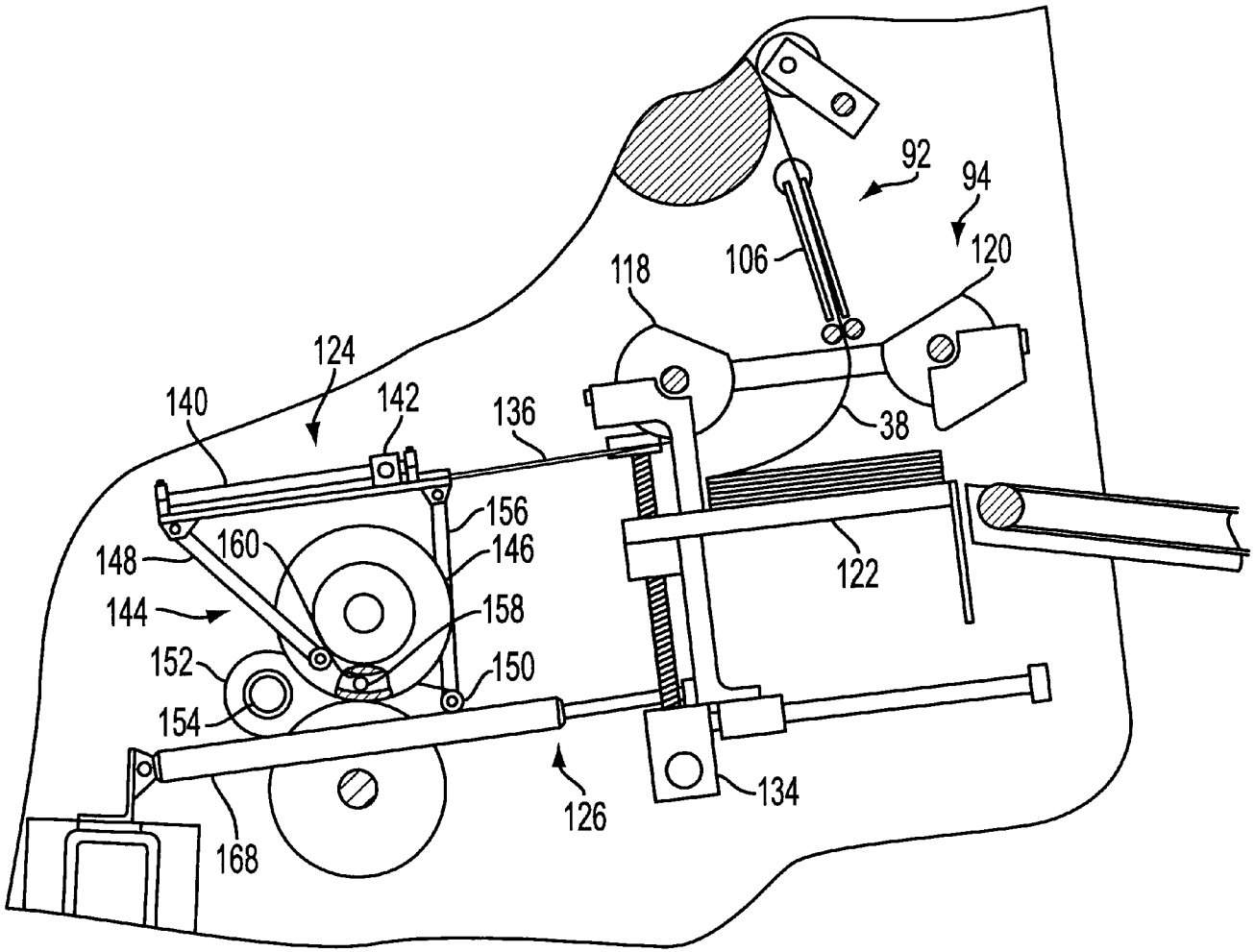

The fingers 136 in the fully extended position are shown in FIG. 12. The fingers form a temporary supporting surface on which the folder unit 92 continues to lay the web in zigzag form. Simultaneously, the pneumatic piston-cylinder assembly 168 is actuated in order to drive the ejector frame 164 across the table 122 and deposit on the conveyor 14 the outgoing stack. This operation is performed without any interruption of the web folding operation. When the ejection procedure has been completed, the pneumatic piston cylinder assembly 168 is retracted to clear the table 122. The table 122 is then raised at a predetermined level by reverse rotation of the threaded shanks. Immediately thereafter, the disk 146 is further rotated in order to bring the fingers 136 to the retracted position. The path of travel which is imparted to the fingers 136 by the 180° sector B of the groove 160, shown in FIG. 15, in which the pin 158 rides during the return movement is such as to provide a first straight section in order to maintain the top of the newly forming stack at the same level while the fingers retract, and a curved terminal section to raise the fingers to a position in which they are ready to perform the next operational cycle. The curved portion of the path is initiated when the tips of the fingers 136 have cleared the stack and the latter has dropped on the table 122. In FIGS. 16 and 17 the return path is identified by the phantom line B.

A detailed description of the various drives for actuating the components of the folding and stacking assembly 30 is not deemed to be necessary here because the design and construction of such drives is well within the reach of a man skilled in the art. It should be noted, however, that the drives must be properly timed to one another in order to achieve the desired synchronism between the components of the assembly 30.

In summary, the apparatus 10 is capable of processing single or multi-layered, multi-form webs in order to cut the web precisely in segments containing the desired number of forms and folding such segments in stacks. This operation is conducted in a continuous fashion, without the necessity of interrupting the machine for the removal of a completed stack therefrom.

To set-up the machine for a production run, a timing adjustment of the rotary cutter assembly 28 must be performed and the characteristics of the web that is to be processed such as the longitudinal form length and the desired number of forms per stack are feed to the programmable controller. The timing adjustment is effected by axial displacement of the drive gear 68 in order to locate a cutting blade 48 in registry with a perforation line 22 of the web on which the cut is to be made, when the blade is in the nip region of the rotary cutter assembly 28. From the two other parameters, the controller determines the sequence of actuation of the cutter assembly by timely raising the anvil roll 46, the oscillation speed of the swing chute 106, the speed of rotation of the knockdown roller assemblies 118 and 120 as well as the operation of the temporary stack support assembly 124 and the ejector assembly 126.

The above-description of a preferred embodiment of this invention should not be interpreted in a limiting manner as refinements and variants of this embodiment are possible without departing from the spirit of the invention. The scope of the invention is defined in the appended claims and by their equivalents.

What is claimed is:

1. A rotary cutter assembly for transversely cutting a moving web, said rotary cutter assembly comprising:

a blade carrier roll;

an elongated blade mounted on said blade carrier roll, said blade extending along an axis of rotation of said blade carrier roll;

an anvil roll mounted generally parallel to said blade carrier roll and defining therewith a nip through which the web is advanced;

means for moving said anvil roll in relation to said blade carrier roll between an operative position and an idle position, whereby in said operative position, said anvil roll is proximate to said blade carrier roll to effect a cut in said web by the action of said elongated blade pressing the web against said anvil roll, and whereby in said idle position, said anvil roll is spaced apart relative to said blade carrier roll, thereby creating a space therebetween;

an actuator coupled to said anvil roll for selectively moving said anvil roll between said operative and idle positions;

a drive including a drive train for transmitting a motive power to rotate said rolls at a tangential speed, whereby the tangential speed is correlated to a translational speed of the web through said rotary cutter assembly, said drive maintaining a driving relationship with said anvil roll and with said blade carrier roll during movement of said anvil roll between said operative and idle positions;

said drive further including first and second gears mounted concentrically to said blade carrier roll and to said anvil roll respectively, said first and second gears being meshed for transmitting movement from one of said rolls to the other of said rolls; and a timing adjustment mechanism being part of the drive and having a drive gear fixedly mounted to a rotatable and selectively axially moveable rotary shaft, said drive gear being meshed with one of said first and second gears such that axial movement of said drive gear causes angular displacement of said first and second gears, a third gear nonrotatably mounted to the rotary shaft for rotation therewith, the third gear being in engagement with said drive train for driving the third gear and the drive gear on the rotary shaft, the third gear maintaining engagement with the drive train even during axial movement of the rotary shaft, whereby said axial movement of said rotary shaft causes said axial movement of said drive gear and said angular displacement of said first and second gears to thereby effect a timing adjustment of the blade carrier roll and the anvil roll.

2. A rotary cutter assembly as defined in claim 1, wherein the drive gear is a helical gear and the third gear is a straight cut gear, and the first and second gears are helical gears such that said axial movement of the drive gear causes said angular displacement of the first and second gears relative to the third gear.

3. A rotary cutter assembly as defined in claim 1, wherein the third gear is axially movable relative to the drive train.

4. A rotary cutter assembly as defined in claim 1, wherein the third gear is slidably mounted to the rotary shaft.

5. A rotary cutter assembly for transversely cutting a moving web, said rotary cutter assembly comprising:

a blade carrier roll;

an elongated blade mounted to said blade carrier roll, said blade extending along an axis of rotation of said blade carrier roll;

an anvil roll mounted generally parallel to said blade carrier roll and defining therewith a nip through which the web is advanced, said anvil roll mounted for movement with relation to said blade carrier roll between operative and idle positions, in said operative position said anvil roll being proximate to said blade carrier roll to effect a cut in said web by the action of said elongated blade pressing the web against said anvil roll, in said idle position said anvil roll being spaced apart with relation to said blade carrier roll, thereby creating a space to allow the web to yield away from said blade carrier roll upon engagement by said elongated blade in order to preclude cutting of the web, an actuator coupled to said anvil roll for selectively moving said anvil roll between said operative and idle positions; and a drive for rotating said rolls at a tangential speed, whereby the tangential speed is correlated to a translational speed of the web through said rotary cutter assembly, said drive maintaining a driving relationship with said anvil roll during movement of said anvil roll between said operative and idle positions, said drive comprising a drive gear coupled to a prime mover, and first and second gears mounted concentrically to said blade carrier roll and to said anvil roll respectively, said first and second gears being meshed for transmitting movement from one of said rolls to the other of said rolls, said drive gear being meshed with one of said first and second gears to cause rotation of said rolls, said drive gear and said first and second gears having teeth extending obliquely with relation to their respective rotation axes, one of said gears being selectively axially moveable along the rotation axis thereof for causing a controlled rotational movement of said blade carrier roll in order to perform a timing adjustment of said blade carrier roll.

6. A rotary cutter assembly as defined in claim 5, further comprising a timing adjusting mechanism for causing said controlled rotational movement of said carrier roll, said timing adjustment mechanism including said drive gear and further including:

a rotary shaft, said drive gear being mounted to said rotary shaft; and a third gear mounted to said rotary shaft, said third gear being in driven relationship with said prime mover, said drive gear being axially moveable with respect to said third gear along a longitudinal axis of said shaft to thereby perform said timing adjustment of said blade carrier roll, said third and drive gears being locked against relative rotational movement for maintaining a driving engagement at various positions of said drive gear relative to said third gear.

7. A rotary cutter assembly as defined in claim 6, wherein said drive gear is locked against rotational and translational movement on said rotary shaft, said third gear being mounted to said rotary shaft and being locked against rotation thereon, whereby movement of said rotary shaft along said longitudinal axis thereof causes the axial movement of said drive gear to effect the timing adjustment of said blade carrier roll.

8. A rotary cutter assembly for cutting a moving web, said assembly comprising:

first rotating means, and cutting means for cutting the web, said cutting means mounted to said first rotating means and extending along an axis of rotation of said first rotating means;

second means defining with the first rotating means a nip through which the web is advanced, said second means mounted for movement with relation to said first means between operative and idle positions, in said operative position said second means being proximate to said first means to effect a cut in said web by action of said cutting means pressing the web against the second means, in said idle position said second means being spaced apart with relation to said first means, thereby creating a space to allow the web to yield away from said first means upon engagement by said cutting means in order to preclude cutting the web;

third means for selectively moving said second means between said operative and idle positions; and fourth means for rotating said first and second means at a tangential speed, whereby the tangential speed is correlated to a speed of the web through said rotary cutter assembly, said fourth means maintaining a driving relationship with said second means during movement of said second means between said operative and idle positions, said fourth means comprising (a) a drive gear coupled to a prime mover, and (b) first and second gears mounted concentrically to said first means and to said second means respectively, said first and second gears being meshed for transmitting movement from one of said first and second means to the other of said first and second means, said drive gear being meshed with one of said first and second gears to cause rotation of said first and second means, said drive gear and said first and second gears having teeth extending obliquely with relation to their respective rotation axes, one of said gears being selectively axially movable along a rotation axis thereof for causing a controlled rotational movement of said first means in order to perform timing adjustments of said first means.

* * * * *